US009776297B2

(12) United States Patent
Veenendall et al.

(10) Patent No.: US 9,776,297 B2
(45) Date of Patent: Oct. 3, 2017

(54) MOWER REEL GRINDING SYSTEM USING PREDETERMINED BRACKET POSITIONS

(71) Applicant: Foley-Belsaw, Wayzata, MN (US)

(72) Inventors: Gregory A. Veenendall, River Falls, WI (US); Andrew R. Chollett, Hager City, WI (US)

(73) Assignee: Foley-Belsaw, Wayzata, MN (US)

( * ) Notice: Subject to any disclaimer, the term of this patent is extended or adjusted under 35 U.S.C. 154(b) by 80 days.

(21) Appl. No.: 14/616,068

(22) Filed: Feb. 6, 2015

(65) Prior Publication Data

US 2016/0229020 A1 Aug. 11, 2016

(51) Int. Cl.
*B24B 3/42* (2006.01)
*B24B 3/36* (2006.01)

(52) U.S. Cl.
CPC ..... *B24B 3/42* (2013.01); *B24B 3/365* (2013.01)

(58) Field of Classification Search
CPC ..... B24B 3/36; B24B 3/365; B24B 3/42
USPC ..... 451/233, 235, 45, 421
See application file for complete search history.

(56) References Cited

U.S. PATENT DOCUMENTS 2,180,911 A * 11/1939 Rogers ..... B24B 3/42 451/141
2,279,798 A * 4/1942 Shelburne ..... B24B 3/42 451/114
2,432,851 A * 12/1947 Anderson ..... B24B 3/42 451/141
4,485,591 A 12/1984 Bolin
5,618,226 A 4/1997 Ueyama
5,879,224 A 3/1999 Pilger
6,010,394 A * 1/2000 Dieck ..... B24B 3/00 451/141
6,290,581 B1 9/2001 Dieck et al.
6,364,750 B2 4/2002 Bauer
6,471,569 B1 10/2002 Bernhard
6,699,103 B1 * 3/2004 Dieck ..... B24B 3/365 451/141

(Continued)

FOREIGN PATENT DOCUMENTS

CA 2 314 786 1/2002
EP 0 308 053 3/1989
WO 82/01341 4/1982

OTHER PUBLICATIONS

International Search Report dated Jun. 22, 2016 in PCT/US2016/016541.

*Primary Examiner* — Robert Rose
(74) *Attorney, Agent, or Firm* — Dicke, Billig & Czaja, PLLC

(57) ABSTRACT

A mower reel grinding apparatus including at least one bracket moveable in a horizontal plane along a positioning axis to any one of a number of predetermined positions and configured to releasably secure to a pivot mechanism of a plurality of types of mower units, the pivot mechanism having a pivot axis, each type of mower unit including a cutting reel positioned at a known location relative to the pivot axis, and each of the predetermined positions corresponding to at least one type of mower unit of the plurality of types of mower units, wherein the at least one bracket is moved to the predetermined position corresponding to the type of mower unit secured thereto such that the cutting reel is positioned at a desired grinding position along the positioning axis when the pivot axis is secured to the bracket.

23 Claims, 17 Drawing Sheets

(56) References Cited

U.S. PATENT DOCUMENTS 6,758,730 B1 7/2004 Bernhard

* cited by examiner

MOWER REEL GRINDING SYSTEM USING PREDETERMINED BRACKET POSITIONS

BACKGROUND

Commercial mowers typically use reel-type mowing units which employ cylindrical cutting reels having a number of helical blades disposed about a central shaft. To ensure optimal cutting performance, the helical blades of the cutting reels must be regularly sharpened. Commercial grinders have been developed to perform such sharpening, which is typically a two part process. First, a spin grinding process is carried out during which the cutting reel is spun counter to a grinding wheel which "squares off" or grinds flat the end of each of the helical blades so as to "true" the reel to its desired cylindrical shape and to form a cutting edge thereon. Second, a relief grinding process is carried out where the grinding wheel individually grinds a relief onto the back of each helical blade.

Mowing units typically include a frame structure to which the cutting reel, a bedknife, a front roller, and a rear roller are mounted. In order for the grinding process to sharpen the blades of the cutting reel as close as possible to OEM (original equipment manufacturer) specifications, the cutting reel must be properly aligned with the grinding wheel(s) of the grinding system. Conventional grinding systems typically secure to and position the cutting reel of mowing units using the front roller.

However, mowing units of different types have different characteristics that often require unique setup requirements. For example, the configuration of the mower unit components may vary between cutting reels of different sizes and between mower units from different manufactures with each configuration requiring a different setup. This is further complicated by the fact that the front roller is often moved to various positions, such as to enable the installation of attachments (e.g. combs, thatchers, groomers, etc.) to the front portion of the frame, thereby making access to the front roller difficult and changing roller positions so that even mowing units of the same manufacturer and model often require different setups for grinding.

In view of the above, while conventional mower reel grinding systems are effective at sharpening cutting reels, such grinding systems often require complicated setup procedures to place the cutting reel in a position for optimal grinding results. Such setup procedures are time consuming and can result in inconsistent and inaccurate sharpening of the cutting reel blades.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1A:
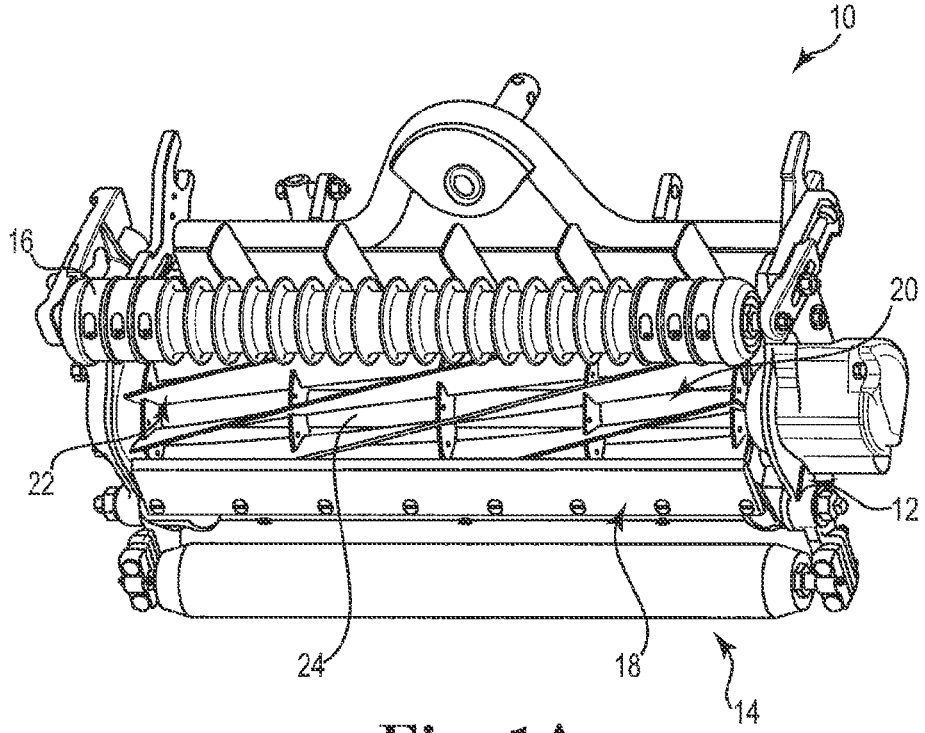
FIG. 1A is a perspective view of an example of a reel-type mower unit.

FIG. 1A is a bottom perspective view generally illustrating an example of a reel-type mower unit 10. Reel-type mowing units, such as mower unit 10 typically include a frame structure 12 to which a rear roller 14, a front roller 16, a bedknife 18, and a cylindrical cutting reel 20 are mounted, wherein cutting reel 20 includes a number of helical blades 22 disposed about a shaft 24.

Figure 1B:
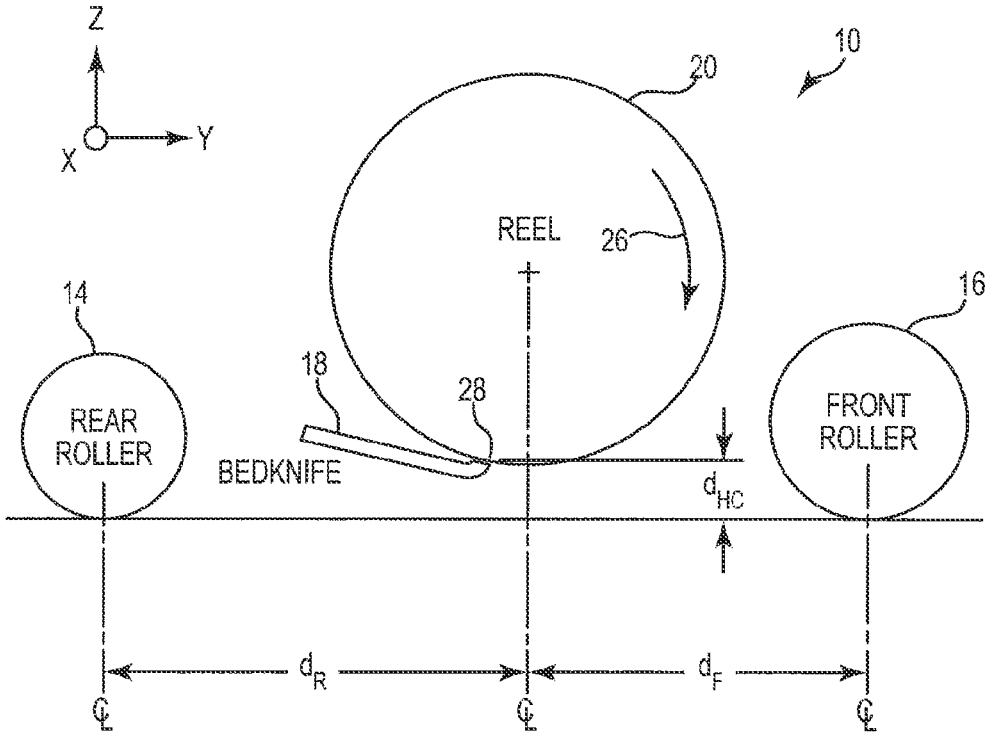
FIG. 1B is a schematic diagram generally illustrating a cross-sectional view of an example of a reel-type mower unit.

FIG. 1B is a simplified schematic diagram illustrating a cross-sectional view showing portions of a typical mower unit, such as mower unit 10. For ease of illustration, frame 12 is not shown in FIG. 1B. As reel 20 rotates, as indicated by rotational arrow 26, grass is cut at a sheer point 28 formed between the helical blades 22 and a leading edge of bedknife 18. A height of cut, $d_{HC}$, of the mower unit is typically adjusted by adjusting the vertical height (z-axis) of front roller 16 relative to central shaft 24 of cutting reel 20. A horizontal distance (y-axis) between a centerline of rear roller 14 and a centerline (i.e. axis of rotation) of cutting reel 20 is indicated as $d_R$, and a horizontal distance between a centerline of front roller 16 and the centerline of cutting reel 20 is indicated at $d_F$.

Figure 2A:
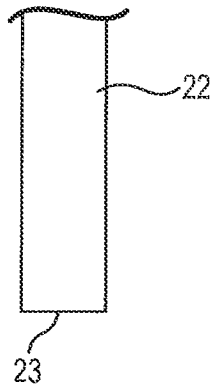
FIG. 2A is a schematic diagram generally illustrating a cross-sectional view of an example of a flat-ground helical blade.
Figure 2B:
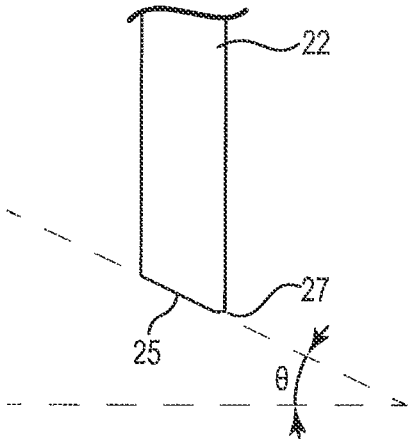
FIG. 2B is a schematic diagram generally illustrating a cross-sectional view of an example of a flat-ground helical blade.

As described above, sharpening is typically a two part process, i.e. a spin grinding process followed by a relief grinding process. FIG. 2A is a schematic diagram generally illustrating portions of a blade 22 after a spin grinding process, which includes positioning a grinding wheel of the grinding system and the cutting reel relative to one another so that the ends of all blades 22 of reel 20 are ground as cutting reel 20 is spun to "true" cutting reel 20 to a cylindrical shape. FIG. 2B is a schematic diagram generally illustrating blade 22 after a relief grinding process, where a grinding wheel is positioned to grind a relief bevel 25 having a relief angle θ onto a backside (or trailing edge) of blade 22 to form a cutting edge 27 that interacts with bedknife 18 to form sheer point 28.

In order to ensure that the grinding process returns reel 20 and blades 22 to OEM specifications, reel 20, and thus, blades 22, must be properly positioned and aligned relative to the grinding wheel(s) used in the grinding process. Conventional grinding systems typically secure to the front roller of the mower unit, such as front roller 16 of mower unit 10 illustrated above by FIGS. 1A and 2A, with some type of support mechanism. The support system and grinding wheel are then adjusted relative to one another to achieve proper positioning of reel 20 relative to the grinding wheel. Such an adjustment process can be difficult, as the distance $d_F$ between the centerline of front roller 16 and the centerline of cutting reel 20 is often different between mower units 10 from different manufactures, and is often different between models of mower units 10 from the same manufacturer. Furthermore, the front roller 16 can be positioned at different horizontal locations for various purposes (e.g. for the installation of accessories such as groomers and brushes) so that distance dF can be different between the same models of cutting units from the same manufacturer. As such, it is often necessary to adjust the positioning to achieve proper alignment each time a different mower unit 10 is to be sharpened, even when mowers units of the same model from the same manufacturer are being consecutively sharpened. Such alignments are time consuming and can result in inconsistent and undesirable grinding results.

In contrast to the distance $d_F$ between the centerlines of the front roller 16 and reel 20, while the vertical position of rear roller 14 may vary, the horizontal distance $d_R$ between the centerlines of the rear roller 14 and cutting reel 20 of a given model of mowing unit is typically at a constant distance, or at least within a tight range of distances. Additionally, attachments and accessories, such as brushes, groomer, and thatchers, for example, are not typically mounted on the rear of the mowing units.

According to the present disclosure, as will be described in greater detail below, a mower reel grinding system is provided which includes moveable mounting brackets that releasably secure to the rear roller of a mower unit, such as rear roller 14 of mower unit 10, or to another predetermined pivot point or rotational axis on the a rear portion of the frame 12 of the mower unit. The mounting brackets are moveable in a horizontal plane to one of a number of predetermined positions along a positioning axis based on characteristics of the mower reel unit 10 (where such characteristics include the manufacturer of mower unit 10 and the size of cutting reel 20, for example) so as to place the cutting reel 20 at a desired position along the positioning axis for grinding. As described herein, such positioning is referred to as horizontal positioning or horizontal placement of the cutting reel 20. Moveable mounting brackets according to the present disclosure provide quicker setup and consistent and accurate horizontal placement of the cutting reel 20 relative to conventional grinding systems and, together with other aspects of the present disclosure, enables accurate and consistent grinding of cutting reel 20 to OEM specifications.

Figure 3:
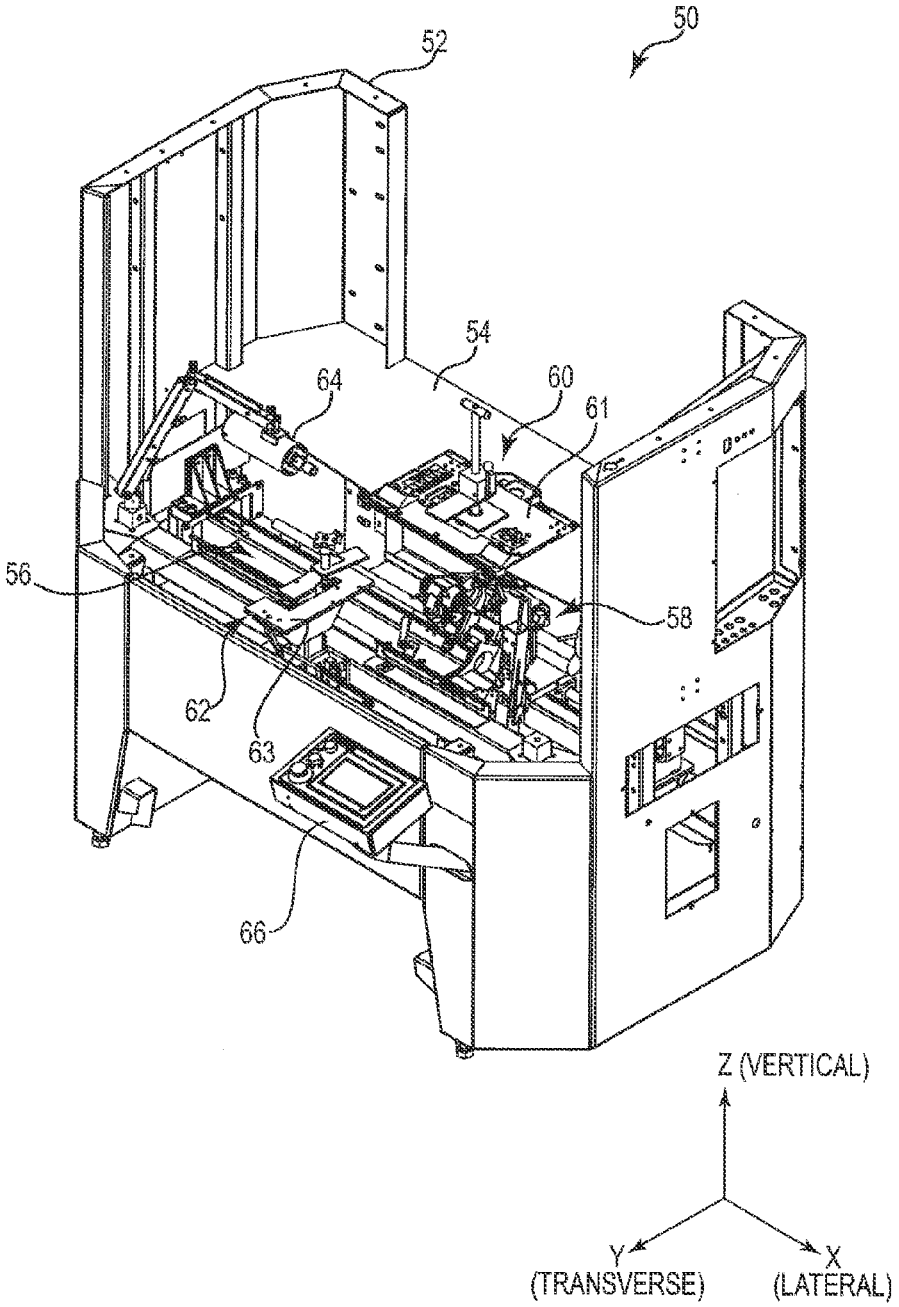
FIG. 3 is a perspective view illustrating a mower reel grinding system according to one example.
Figure 4A:
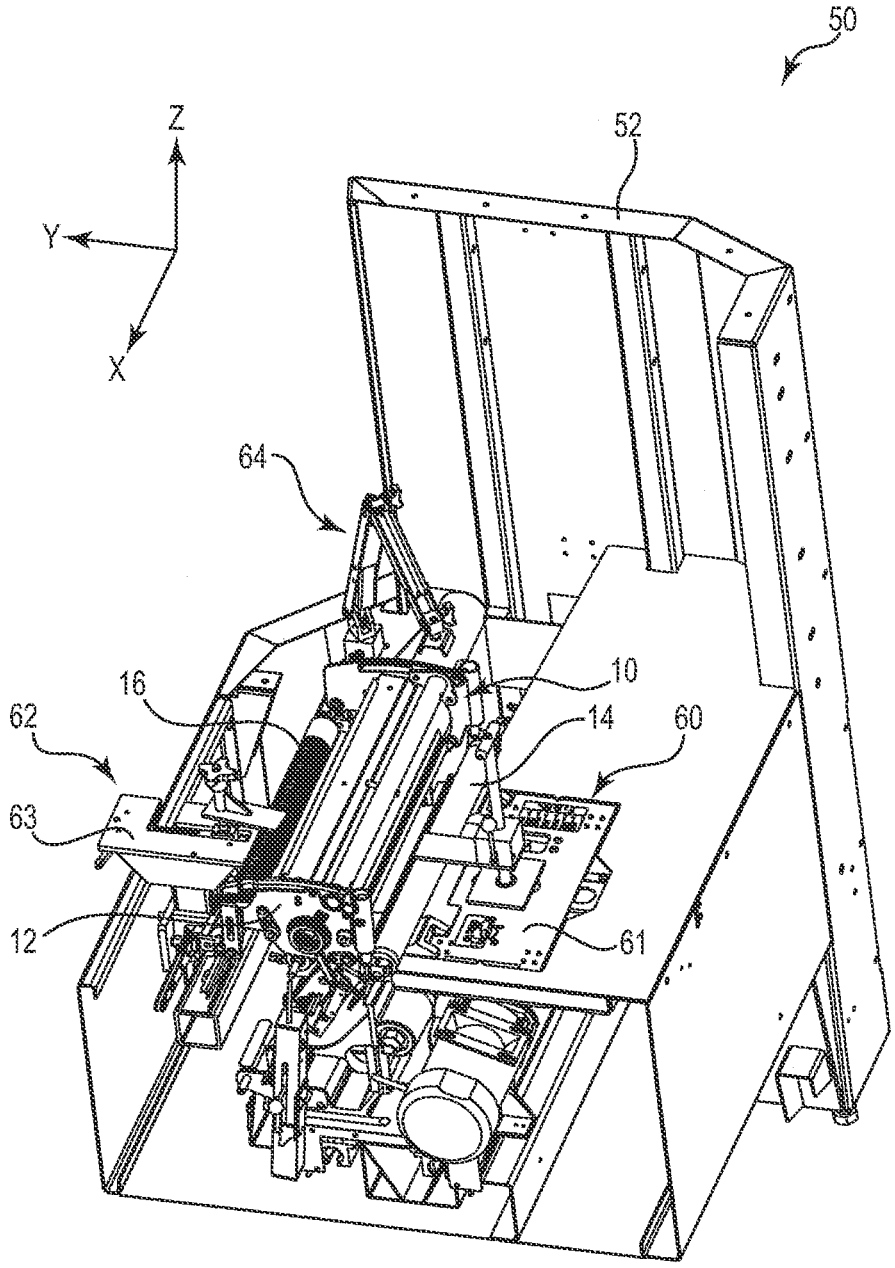
FIG. 4A is a perspective view illustrating a mower reel grinding system, according to one example, with a mower unit mounted thereto.
Figure 4B:
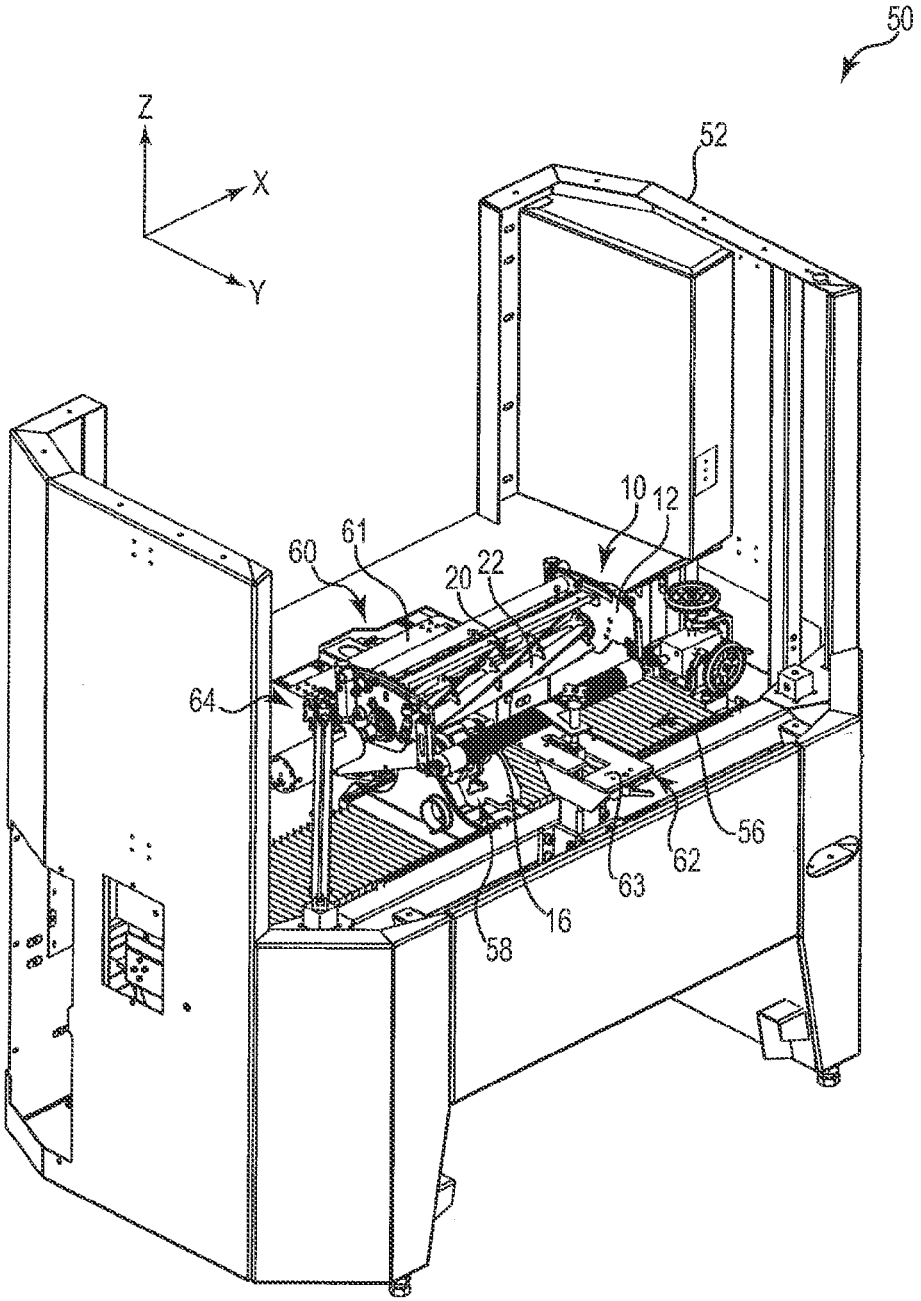
FIG. 4B is a perspective view illustrating a mower reel grinding system, according to one example, with a mower unit mounted thereto.

FIG. 3 is a perspective view illustrating portions of an example of a mower reel grinding system 50 including a cutting reel and grinder alignment system according to the present disclosure. Grinding system 50 includes an enclosure 52 having a shelf 54, a traverse base assembly 56, a moveable grinding head assembly 58, a rear mounting assembly 60 including a horizontally moveable (i.e. y-axis or transverse direction) mounting platform 61, a front mounting assembly 62 including vertically movable support pedestal 63, a spin drive system 64, and a microprocessor controller 66. FIGS. 4A and 4B provide perspective views of the mower reel grinding system 50 of FIG. 1 illustrating a mower unit 10 having a rear roller 14 releasably secured to rear mounting platform 60 and a front roller 16 releasably secured to front support platform 62 with a cutting reel 20 in position for grinding by grinding head assembly 58, wherein the mounting and position of mower unit 10 will be described in greater detail below.

Figure 5:
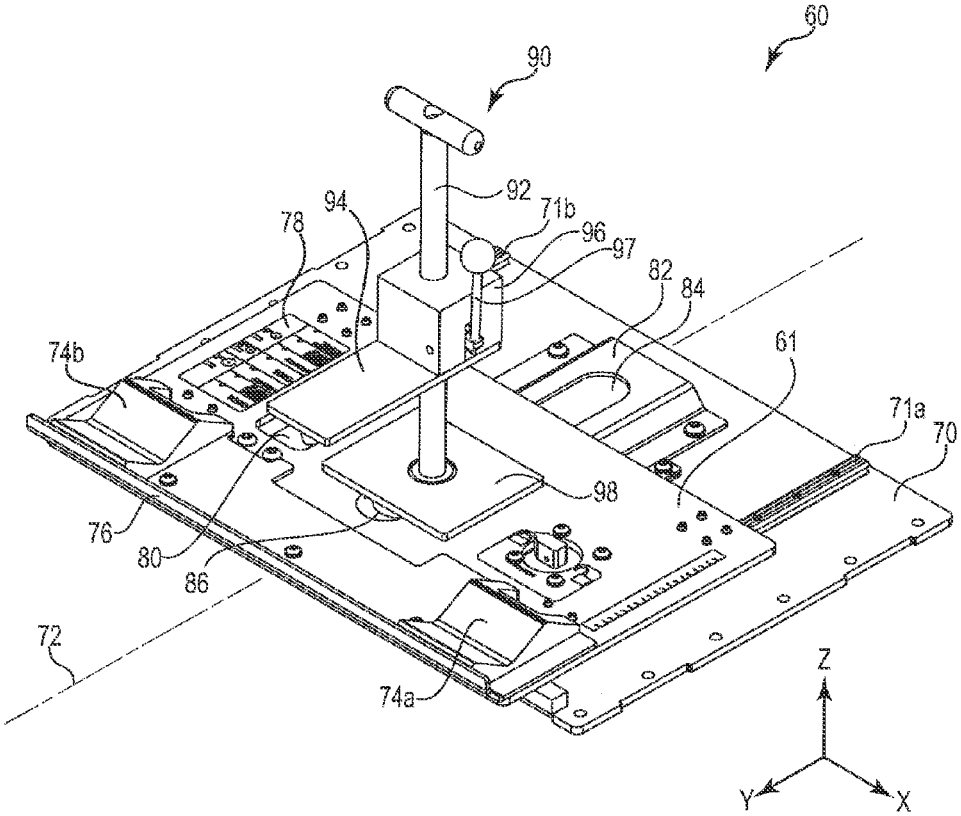
FIG. 5 is a perspective view illustrating a rear mounting assembly according to one example.

FIG. 5 is a perspective view illustrating an example of rear mounting assembly 60 including horizontally moving mounting platform 61 according to the present disclosure. In addition to mounting platform 61, rear mounting assembly 60 includes a base portion 70 (which may be a part of shelf 54 of enclosure 52) having a pair of rails 71*a*, 71*b* on which mounting platform 61 can move horizontally back and forth in the y-plane along a positioning axis 72. A pair of v-shaped (although other geometries could be employed) brackets 74*a*, 74*a* are positioned on mounting platform 61 proximate to a leading edge 76 and are configured to receive and center rear roller 14 of mowing unit 10 (see FIG. 4A, for example). A horizontal position indexer 78 disposed on mounting platform 61 and a position selector 80 operate in conjunction with one another to set mounting platform 61 to one of plurality of predetermined positions along positioning axis 72 (see FIGS. 6A and 6B below).

A base channel 82 having a slot 84 there through, which corresponds to a slot 86 through mounting platform 61, works with clamp assembly 90 to secure mounting platform 61 to base portion 70 when mounting platform is positioned at a desired location along position axis 72. Clamp assembly 90 includes a shaft 92, from which extends a flange 94, a cam mechanism 96, a set-arm 97, a base plate 98, and a flange element (not shown) extending through slots 84 and 86 and engaging base channel 82. It is noted that set-arm 97 is shown in a release position where cam mechanism 96 is not set so that clamp assembly 90 is free to move within slots 84 and 86 and mounting platform 61 is able to move along positioning axis 72.

Figure 6A:
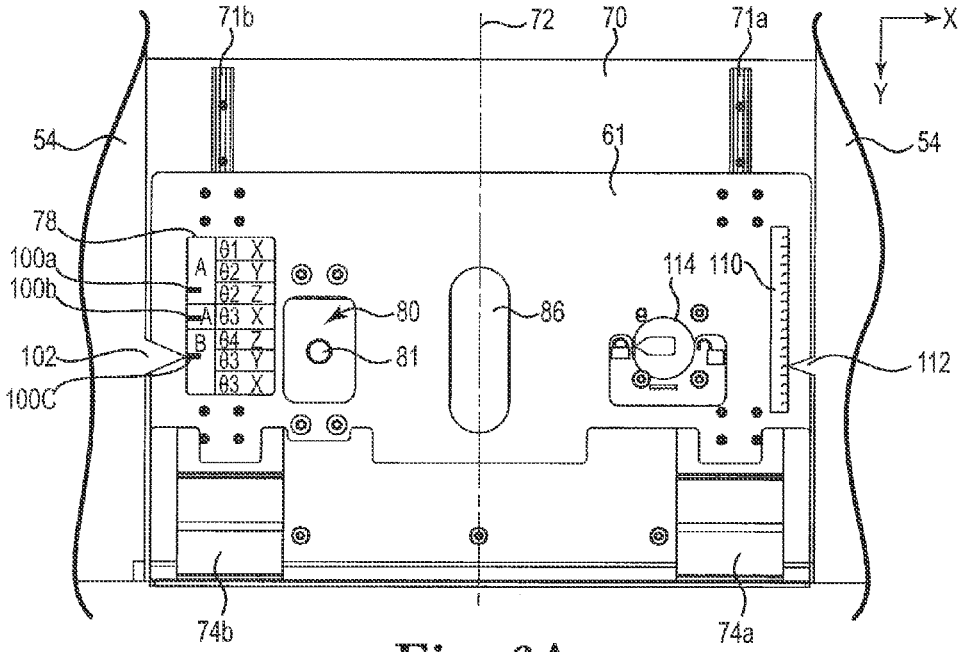
FIG. 6A is a top view illustrating a rear mounting assembly in a first preset position, according to one example.
Figure 6B:
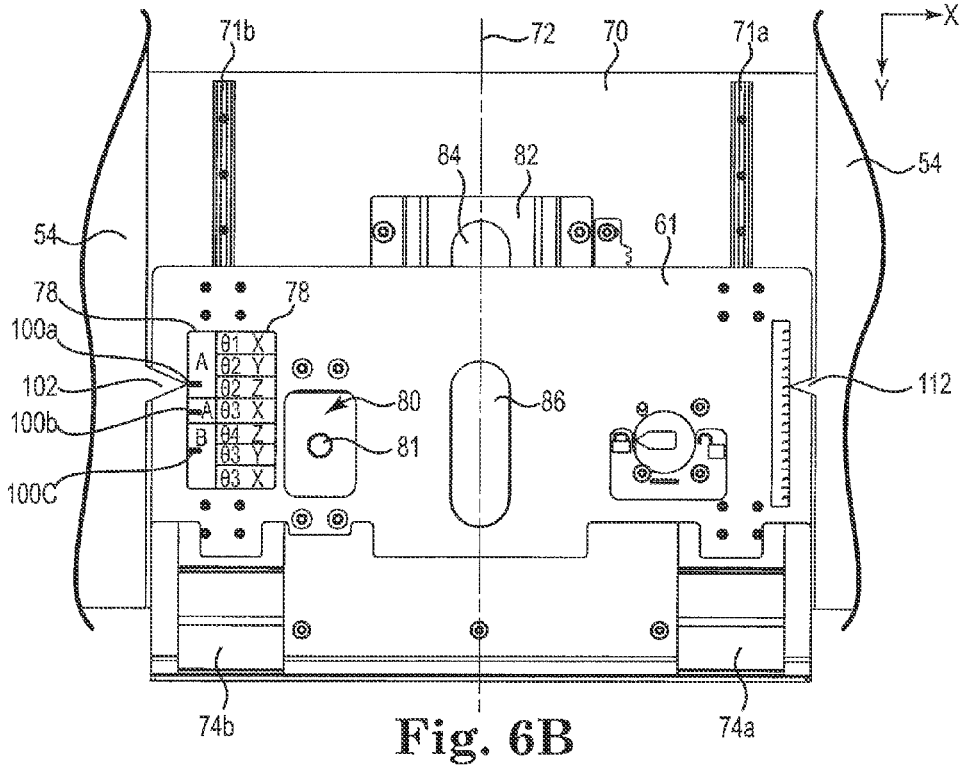
FIG. 6B is a top view illustrating a rear mounting assembly in a second preset position, according to one example.

FIGS. 6A and 6B illustrate top views of rear mounting assembly 60 of FIG. 5, with clamp assembly 90 removed and position indexer 78 and position selector 80 illustrated in greater detail. According to one example, position indexer 78 includes a plurality of index markings, such as index markings 100*a*, 100*b*, and 100*c*, wherein each index marking corresponds to one or more different types of mower units 10. For instance, in the example illustrated by FIG. 6A, index marking 100*a* corresponds to three different types of mower units: a first type by manufacturer "X" having a reel size "A" (e.g. 5-inch diameter) and requiring a relief angle of "θ1" (e.g. 3-degrees); a second type by manufacturer "Y" having a reel size "A" and requiring a relief angle of "θ2" (e.g. 5-degrees); and third type by manufacturer "Z" having a reel size "A" and requiring a relief angle of "θ2". Similarly, index marking 100*b* corresponds to one type of mower unit by manufacturer "X" having a reel size "A" and requiring a relief angle of "θ3" (e.g. 6-degrees). Finally, index marking 100*c* corresponds to three different types of mower units: a first type by manufacturer "Z" having a reel size "B" (e.g. 7-inch diameter) and requiring a relief angle of "θ4" (e.g. 12-degrees); a second type by manufacturer "Y" having a reel size "B" and requiring a relief angle of "θ3"; and third type by manufacturer "X" having a reel size "B" and requiring a relief angle of "θ3".

It is noted that position indexer 78 can have any number of index markings (e.g. more or fewer than three as illustrated), with each index marking having at least one corresponding type of mower unit 10.

According to one example, position selector 80 is a moveable selector pin 81 which is biased downward toward base portion 70 and extends into one of a number of corresponding openings (not shown) in base portion 70, each of which corresponds to one of the index markings, such as index markings 100*a*-100*c*, aligning with a pointer element 102 disposed at a fixed position on shelf 54.

In FIG. 6A, moveable mounting platform 61 is illustrated as being positioned so that pointer element 102 is aligned with index marking 100*c*. At this position, when the rear roller 14 of any one of the three types of corresponding types of mower units 10 is positioned within v-brackets 74*a*, 74*b*, the axis of rotation (i.e. shaft 24) of cutting reel 10 will be positioned at a desired grinding position along positioning axis 72 for that particular type of mower unit.

Similarly, in FIG. 6B, moveable mounting platform 61 is illustrated as being positioned so that pointer element 102 is aligned with index marking 100*a*. At this position, when the rear roller 14 of any one of the three types of corresponding types of mower units 10 is positioned within v-brackets 74*a*, 74*b*, the axis of rotation (i.e. shaft 24) of cutting reel 10 will be positioned at a desired grinding position along positioning axis 72 for that particular type of mower unit.

To move mounting platform 61 from one position to another, such as from the position illustrated in FIG. 6A to the position illustrated in FIG. 6B, selector pin 81 is lifted upward and mounting platform is moved along positioning axis 72 until pointer element 102 aligns with index marking 100*a*. Selector pin 81 is then released so as to engage the corresponding opening (not shown) in base portion 70 and hold mounting platform 61 in place. After the rear roller 14 of a corresponding type of mower unit 10 is placed in v-brackets 74*a*, 74*b*, flange 94 of clamp assembly 90 is slid down shaft 92 onto the rear roller 14. Set-arm 97 is then rotated and pushed downward to operate cam mechanism 96 which simultaneously forces flange 94 downward and shaft 92 upwards, thereby simultaneously securing the rear roller 14 to v-brackets 74*a*, 74*b* and mounting platform 61 to base channel 82 (see FIG. 4A).

It is noted that suitable clamping mechanisms other than clamping assembly 90 may be employed to secure rear roller 14 to brackets 74*a*, 74*b* and to secure mounting platform 61 to base channel 82.

In example, rear mounting assembly 60 further includes ruler marking 110, a position pointer 112, and a rotatable locking switch 114 which are employed when a type of mower unit 10, which is not included among the types of known mower units having corresponding index markings on position indexer 78, is to be sharpened by grinding system 50. According to such a scenario, after placing the rear roller 14 of such unknown type of mower unit 10 into brackets 74*a*, 74*b*, and after positioning the cutting reel 20 into a desired position for grinding (as will be described in greater detail below), the location of position pointer 112 on ruler marking 110 is noted and used for quick positioning of such type of mower units 10 in the future. Rotatable locking switch 114 provides a function similar to that of moveable selector pin 81, but is not limited to detaining mounting platform 61 at a finite number of locations where corresponding openings are positioned in base portion 70 as is moveable selector pin 81.

Figure 7:
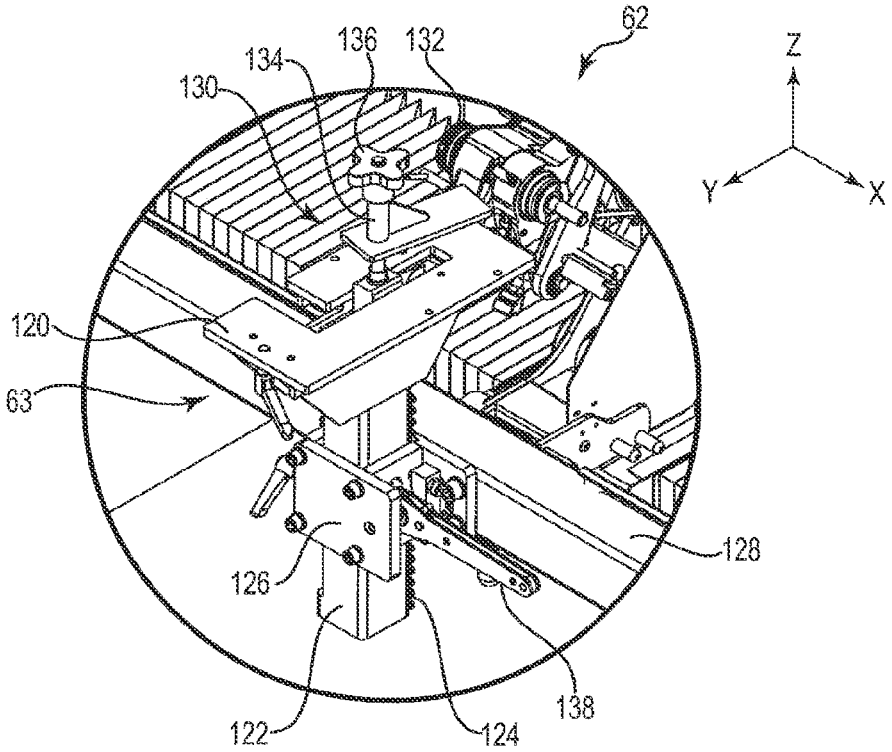
FIG. 7 is a perspective view illustrating a front mounting assembly according to one example.

FIG. 7 is a perspective view illustrating front mounting assembly 62 including vertically movable support pedestal 63 according to one example of the present disclosure. Support pedestal 63 includes a planar top surface 120 having a support shaft 122 with a rack gear 124 disposed thereon extending downwardly through a retaining collar 126 that is mounted to a structural element 128 of frame 52. A front roller clamp assembly 130 extends upwardly from top surface 120 and includes a flange 132 extending horizontally from a shaft 134 and which is free to rotate there about. Shaft 134 is threadably coupled to an upper end of support shaft 122 and includes a screw knob 136 for tightening/loosening flange 132 against front roller 16 of a mower unit 10 placed on top surface 120 (see FIG. 4A, for example). A ratchet 138 is mounted to retaining collar 126 and includes a spur gear (not shown) which operatively engages rack gear 138 to vertically raise and lower support pedestal 63.

Figure 8:
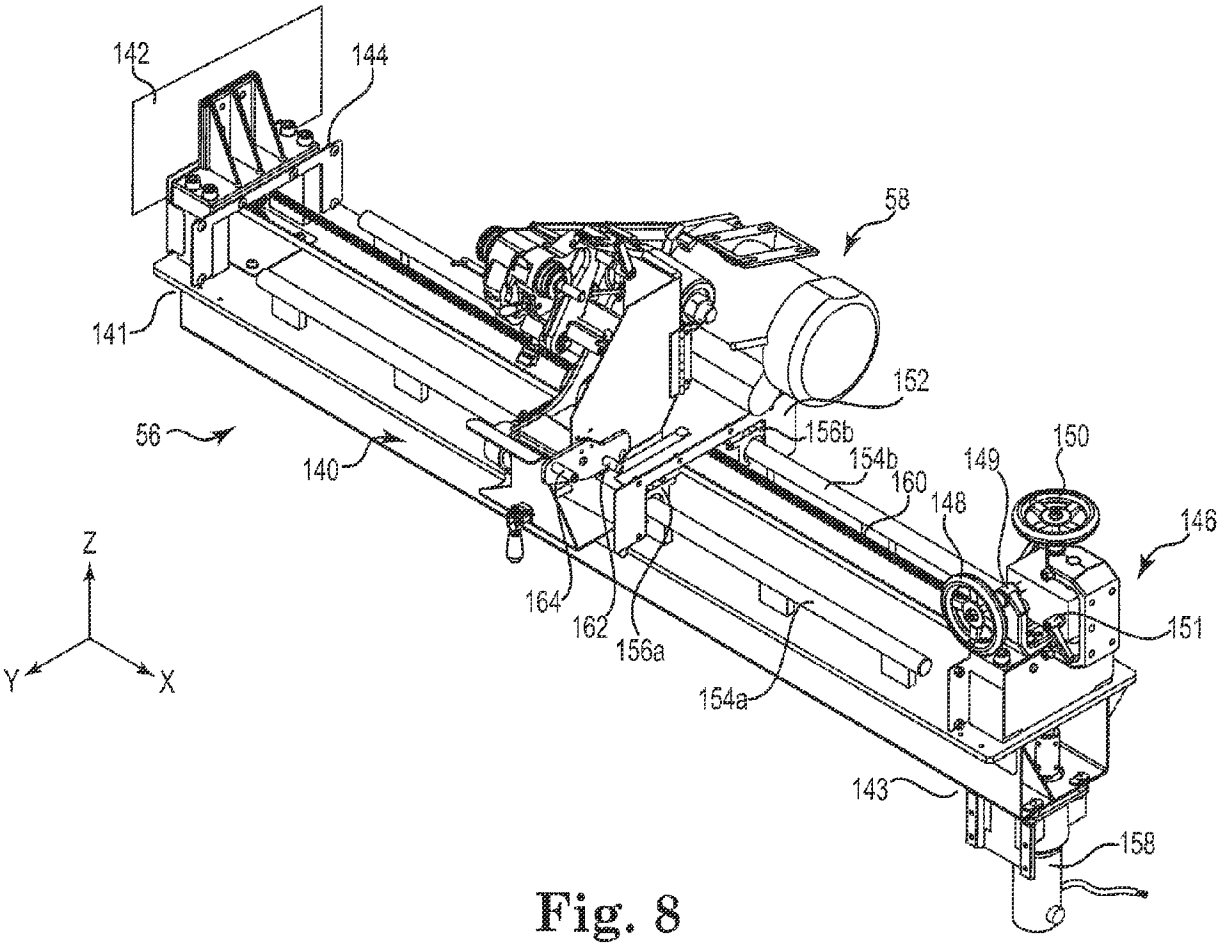
FIG. 8 is a perspective view illustrating a traverse base assembly and a grinding head assembly, according to one example.

FIG. 8 is an enlarged perspective view illustrating traverse base assembly 56 and moveable grinding head assembly 58 according to one example of the present disclosure. Traverse base assembly 56 includes a support beam 140 which is mounted at a first end 141 to a frame element 142 of enclosure 52 via a flexible mounting assembly 144 that enables first end 141 of beam support 140 to pivot about the y- and z-axes. The opposing end 143 of support beam 140 is connected to an adjustable mounting 146 which includes a first wheel 148 for adjusting a horizontal position (i.e. in the x-y plane) of support beam 140 and which is locked in place with a lever 149, and a second wheel 150 for adjusting a vertical position (i.e. in the x-z plane) of support beam 140 and which is locked in place with a lever 151.

Traverse base assembly 56 further includes a carriage 152 to which grinding head assembly 58 is mounted. Carriage 152 is slideably mounted to a pair of guide rods 154*a*, 154*b* via corresponding pair of bearing blocks 156*a*, 156*b*. A drive motor 158 drives a continuous belt 160 which is operatively connected to carriage 152 to reciprocally drive carriage 152 and thus grinding head assembly 58, transversely (i.e. along x-axis) along guide rods 154*a*, 154*b*.

In one example, as illustrated, carriage 152 includes first and second mounting pins 162 and 164 which, as will be described in greater detail below, are used for mounting an electronic linear measuring gauge that is used when adjusting first and second wheels 148 and 150 to align grinding head assembly 58 with shaft 24 of reel 20 of a mower unit 10 mounted in grinding system 50 for sharpening.

Figure 9:
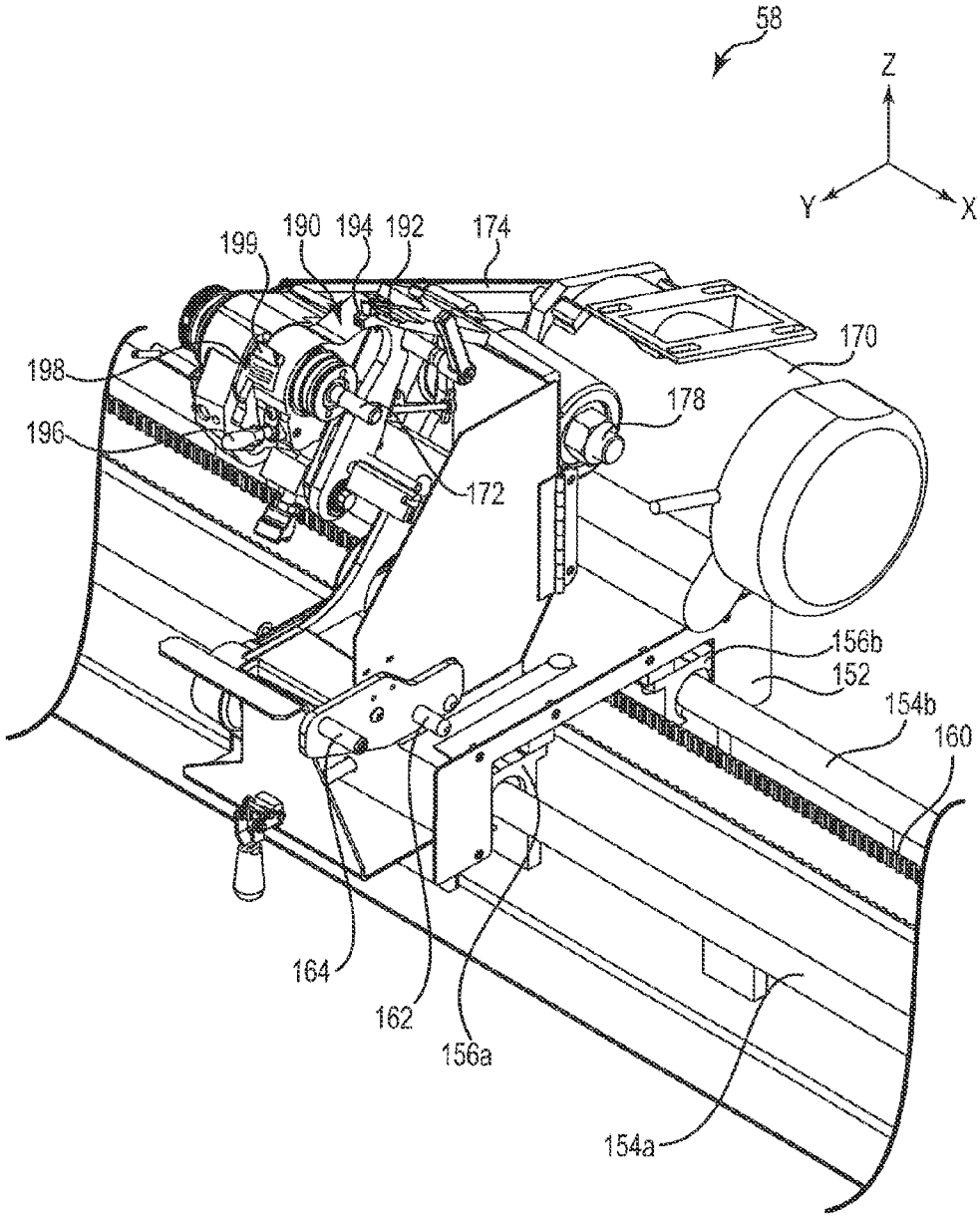
FIG. 9 is a perspective view illustrating a grinding head assembly according to one example.

FIG. 9 is a perspective view illustrating grinding head assembly 58 according to one example of the present disclosure. Grinding head assembly 58 includes a motor 170 that drives a grinding wheel shaft 172 via a belt and pulley system (not shown) enclosed within a housing 174. For clarity of illustration, a grinding wheel 176 which is mounted on grinding wheel shaft 172 (see FIGS. 10A/10B/11A/11B) is not shown in FIG. 9. Grinding head assembly 58 is mounted to carriage 152 via a pivot axis 178 which enables grinding wheel shaft 172 to be rotated toward and away from a cutting reel 20 of a mower unit 10 when mounted to grinding system 50.

Figure 10A:
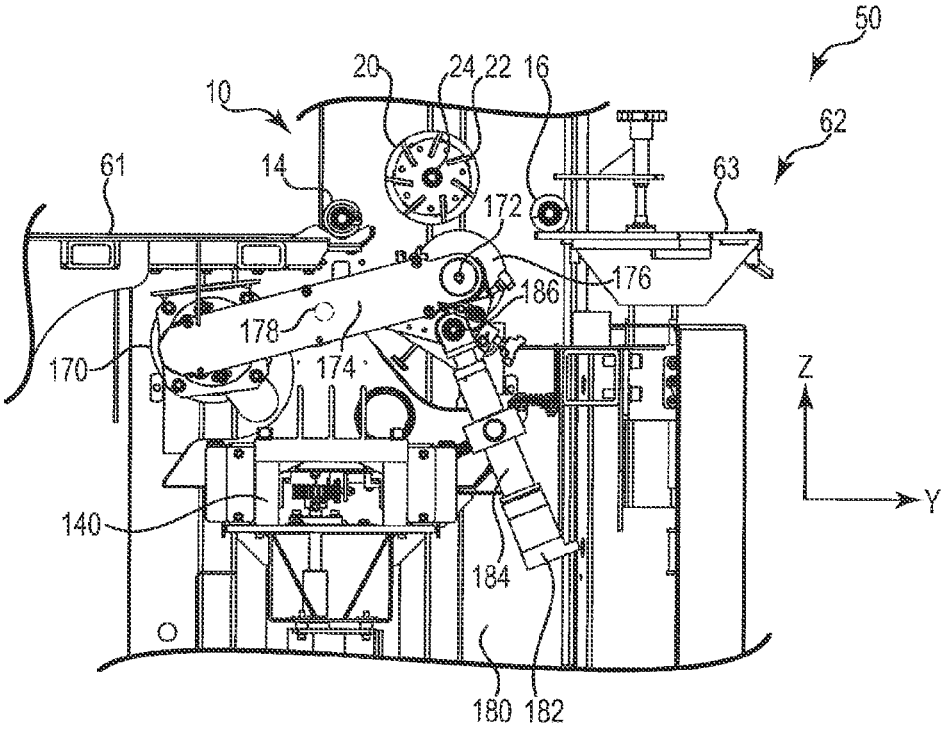
FIG. 10A is a side view illustrating a grinding head assembly, according to one example, in disengaged position.
Figure 10B:
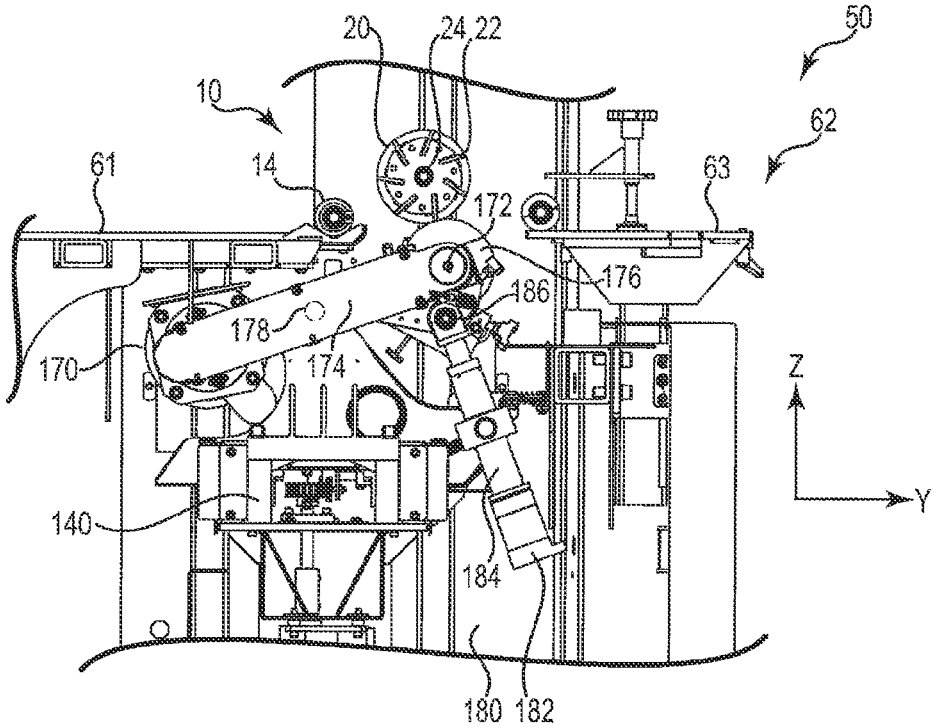
FIG. 10B is a side view illustrating a grinding head assembly, according to one example, in an engaged position.

FIGS. 10A and 10B are end views illustrating grinding head assembly 58 and portions of grinding system 50. In FIGS. 10A and 10B, a mower unit 10 (with frame 12 not shown for clarity) is illustrated as being mounted to grinding system 50 with rear roller 14 positioned on brackets 74*a*, 74*b* of moveable rear mounting platform 61 and front roller 16 positioned on support pedestal 63 of front mounting assembly 62. Grinding head assembly 58 includes an actuating system 180 including a stepper motor 182 that drives telescoping tubes 184, the outermost of which is coupled via a pivot 186 to housing 124, to rotate grinding wheel 176 about pivot access 178 so as vertically position grinding wheel 176 relative to reel 20 of mower unit 10 to perform spin and relief grinding processes. FIG. 10A illustrates grinding head assembly 58 in a retracted or disengaged position where grinding wheel 176 is spaced from cutting reel 20. FIG. 10B illustrates grinding head assembly 58 in an extended or engaged position where grinding wheel 176 is positioned so as to contact blades 22 of cutting reel 20 for grinding.

Returning to FIG. 9, grinding head assembly 58 further includes a relief grinding index/guide assembly 190 including a guide finger 192 and an index stop finger 194 similar to that described by U.S. Pat. No. 6,290,581 entitled "Automatic Mower Reel Grinder", which is assigned to the same Assignee as the present application, and which is herein incorporated by reference in its entirety. Index/guide assembly 190 further includes a screw knob 196, a relief angle indexer 198, and a pointer 199 which, as will be described below, are employed to adjust a position of guide finger 192 relative to grinding wheel 176 in order to adjust a degree of relief angle θ of relief bevel 25 ground onto blades 22 (see FIG. 2A) during the relief grinding process.

Figure 11A:
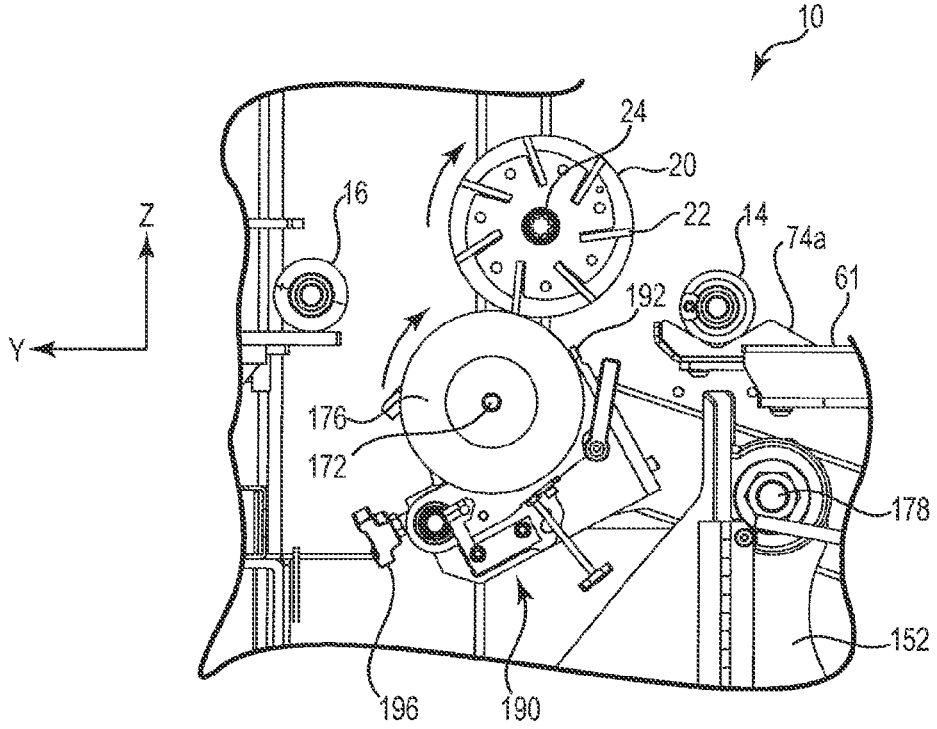
FIG. 11A is a side view illustrating an index/guide assembly of a grinding head assembly, according to one example, in a disengaged position.
Figure 11B:
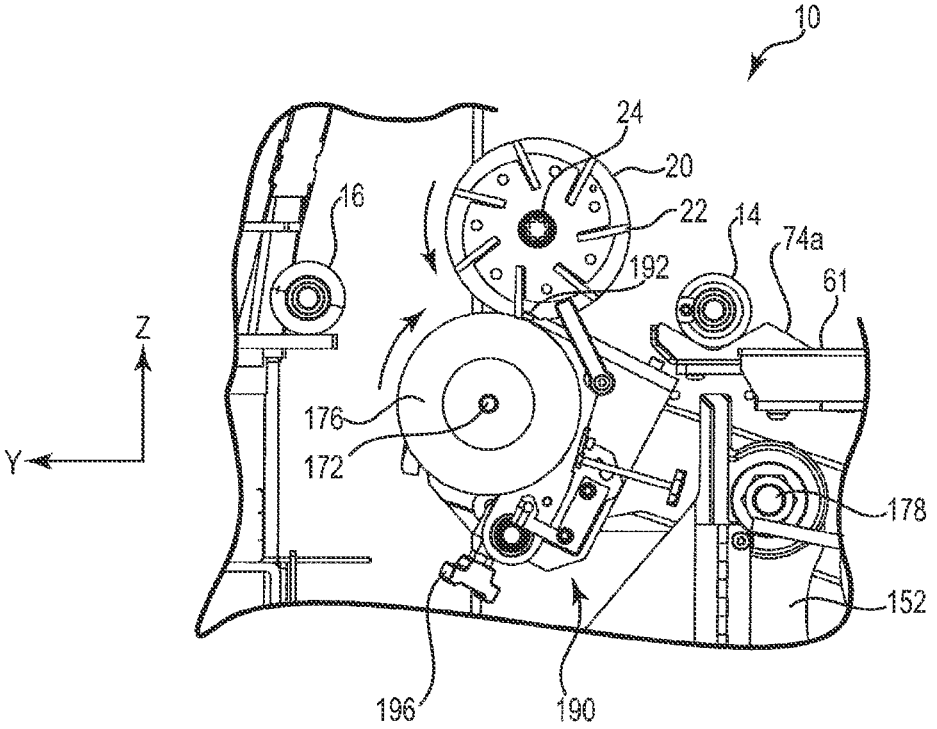
FIG. 11B is a side view illustrating an index/guide assembly of a grinding head assembly, according to one example, in an engaged position.

FIGS. 11A and 11B illustrate side views of grinding head assembly 58, including index/guide assembly. Index/guide assembly 190 is rotatable about grinding wheel shaft 172 and between an engaged and a disengaged position. FIG. 11A shows index/guide assembly 190 in disengaged position where guide finger 192 and index stop finger 194 are positioned down and away from cutting reel 20, and illustrates a spin grinding process where grinding wheel 176 and cutting reel 20 are each rotated clockwise as grinding wheel 176 grids the ends of blades 22 to restore cutting reel 20 to a cylinder.

FIG. 11B shows index/guide assembly 190 in an engaged position where guide finger 192 is positioned to engage a leading edge of blade 22, and illustrates a relief grinding process. During a relief grinding process, grinding wheel 176 is rotated clockwise while cutting reel 20 is rotated counter-clockwise such that blade 22 is rotationally biased against guide finger 192 (by spin drive system 64), which holds blade 22 in place as grinding wheel 176 grinds relief bevel 25 onto the trailing edge of blade 22, wherein the relief angle θ of the relief bevel 25 depends on the positioning of guide finger 192 relative to grinding wheel 176.

Referring to FIG. 9, according to one example of the present disclosure, relief angle indexer 198 includes a plurality of index markings, including markings which correspond to each of the angle settings θ1, θ2, θ3, and θ4 as indicated on horizontal position indexer 78 of moveable mounting platform 61 (see FIGS. 6A, 6B). To set guide finger 192 to a position which will result in grinding wheel 176 producing a relief bevel 25 having particular relief angle θ, such as θ1 for instance (e.g. 3-degrees), screw know 196 of index/guide assembly 190 is turned to align pointer 199 with the index marking of relief angle indexer 198 corresponding to angle θ1.

An example of a process for mounting a mower unit 10 in grinding system 50 in order to perform spin and relief grinding of cutting reel 20 is described below. To begin, moveable mounting platform 61 is moved so that pointer element 102 is aligned with an index marking of position indexer 78 that corresponds to the type of mower unit 10 being mounted. For example, if mower unit 10 is that of manufacturer "Y" having a reel size "A" and requiring a relief angle of θ2, mounting platform 61 is moved until pointer element 102 is aligned with index marking 100*a* (see FIG. 6B). Rear roller 14 is then positioned in brackets 74*a*, 74*b* and front roller 16 is placed on support pedestal 63 of front mounting assembly 62.

Figure 12:
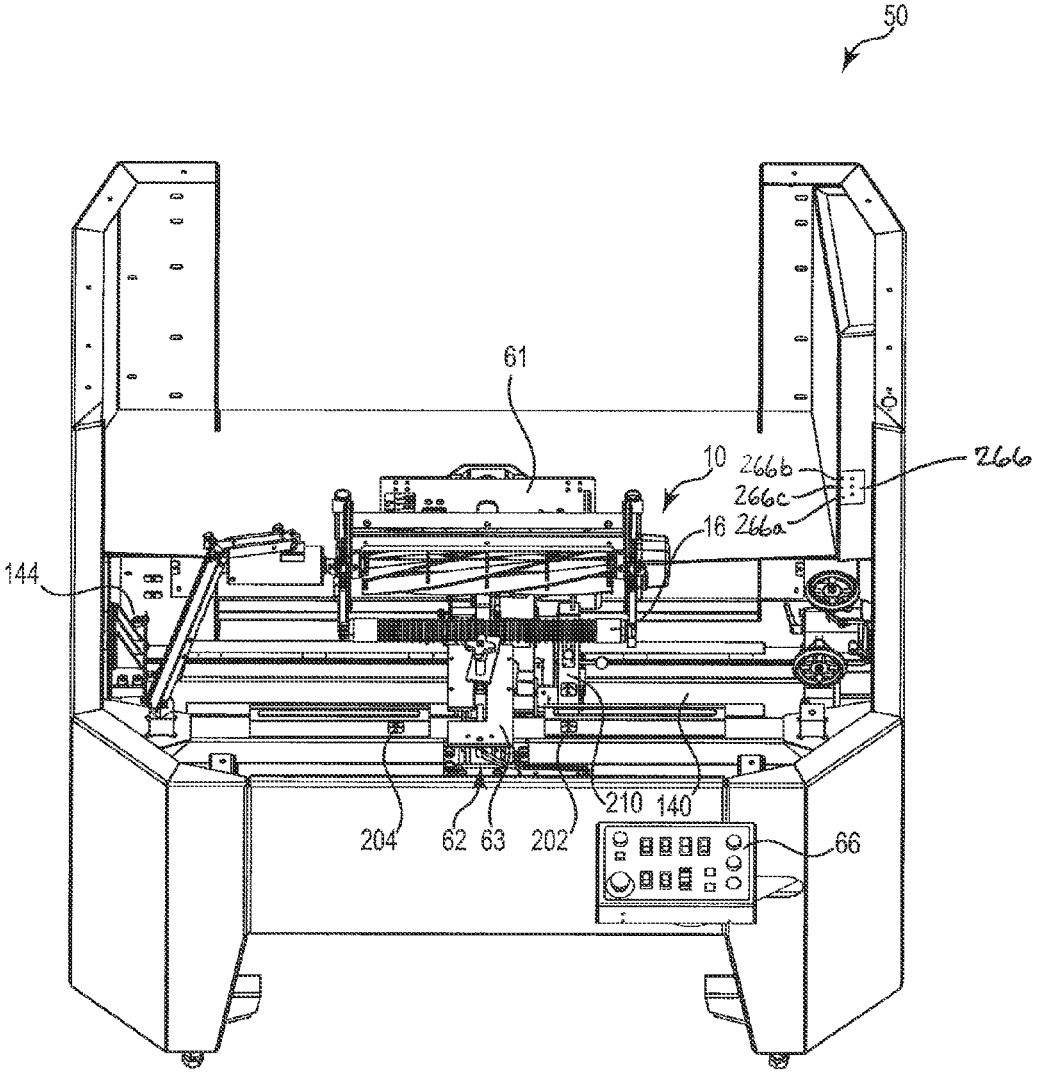
FIG. 12 is front perspective view of a mower reel grinding system, according to one embodiment, illustrating a mower unit positioned therein.

FIG. 12 is a front perspective view of grinding system 50 illustrating mower unit 10 with a rear roller 14 positioned on mounting platform 61 and front roller 16 positioned on support pedestal 63 of front mounting assembly 62. Additionally illustrated are first and second location markers 202 and 204 on frame elements within enclosure 52 and which are respectively positioned at predetermined and known first and second distances along support beam 140 of traverse base assembly 56 from the pivot point of traverse base assembly formed by flexible mounting assembly 144 (see FIG. 8 above).

Figure 13:
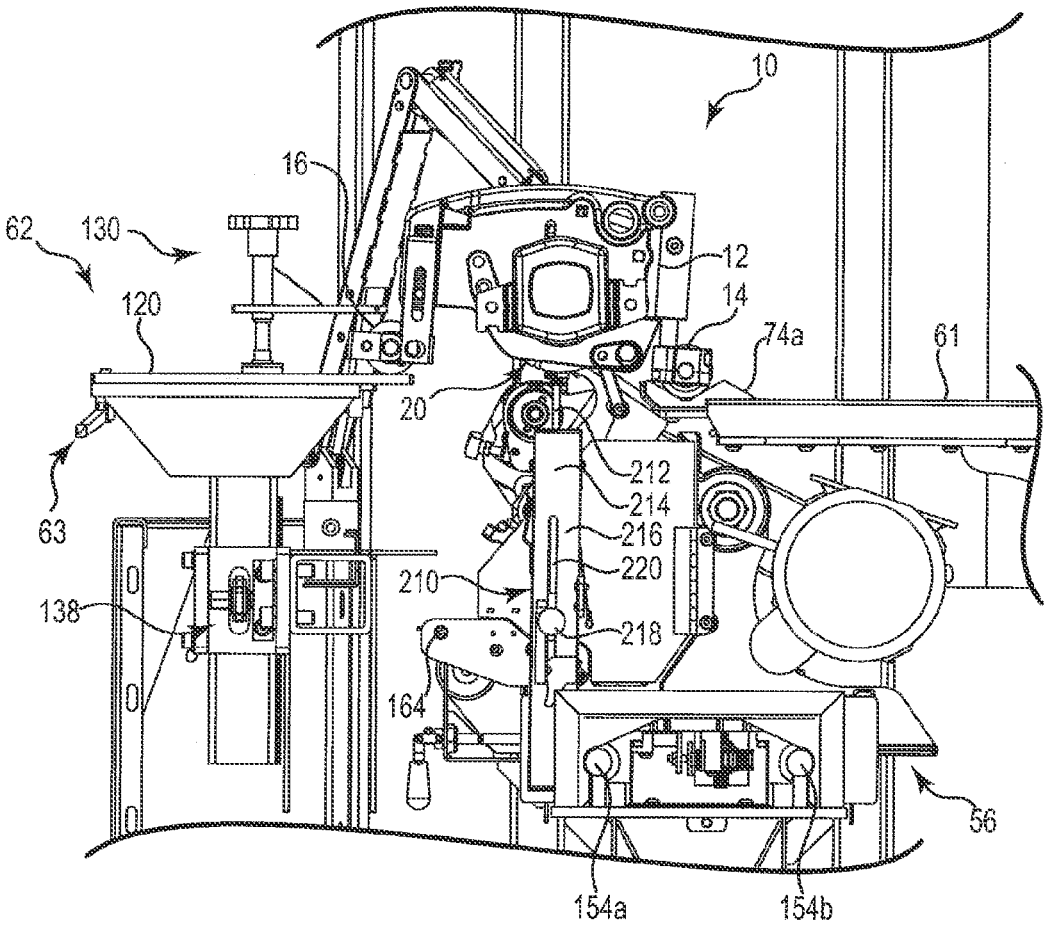
FIG. 13 is a side view of portions of a mower reel grinding system and showing a linear distance gauge positioning, according to one example.

FIG. 13 is a right side view illustrating portions of grinding system 50 according to one example. After rear roller 14 has been positioned in brackets 74*a*, 74*b* and front roller 16 has been positioned on top surface 120 of support pedestal 63 of front mounting assembly 62, an electronic linear distance gauge 210 is mounted to first mounting pin 162 of carriage 152 of traverse base assembly 56 (see FIG. 8). According to one example, linear distance gauge 210 includes a linearly moveable measuring shaft 212 which is biased so as to extend from an end 214 of a housing 216.

With reference to FIG. 12, carriage 152 is then moved so that linear distance gauge 210 aligns with first location marker 202. Once linear distance gauge 210 has been aligned with first location marker 202, the distal end of measuring shaft 212 is positioned on an edge of helical cutting blade 22 after cutting reel 20 has been rotated so that helical blade 22 is at the lowest point of cutting reel 20.

Ratchet 138 of front mounting assembly 62 is then employed to move support pedestal 63 vertically up or down until linear distance gauge 210 provides indication that the traverse base is at a predetermined distance ($d_{BR}$) from the bottom of cylindrical cutting reel 20. In one example, indication is provided on linear distance gauge 210 itself. For instance, according to one example, a pin 218 is coupled to measuring shaft 212 and slides within a slot 220 in housing 216 of linear distance gauge 216 as measuring shaft 212 moves up/down, with the predetermined distance $d_{BR}$ being indicated when the pin 218 aligns with an index mark on housing 216. According to another example, linear distance gauge 216 provides a signal to microcontroller 66 which provides indication of the predetermined distance $d_{BR}$ being achieved via a graphical user interface (GUI) or other means.

It is noted that the predetermined distance $d_{BR}$ will be the same for all types of mower reels 10. In other words, the distance $d_{BR}$ to the outside side edge of cutting reel 10 is adjusted so as to be the same for all cutting reels regardless of size (e.g. 5- and 7-inch reels).

Figure 14:
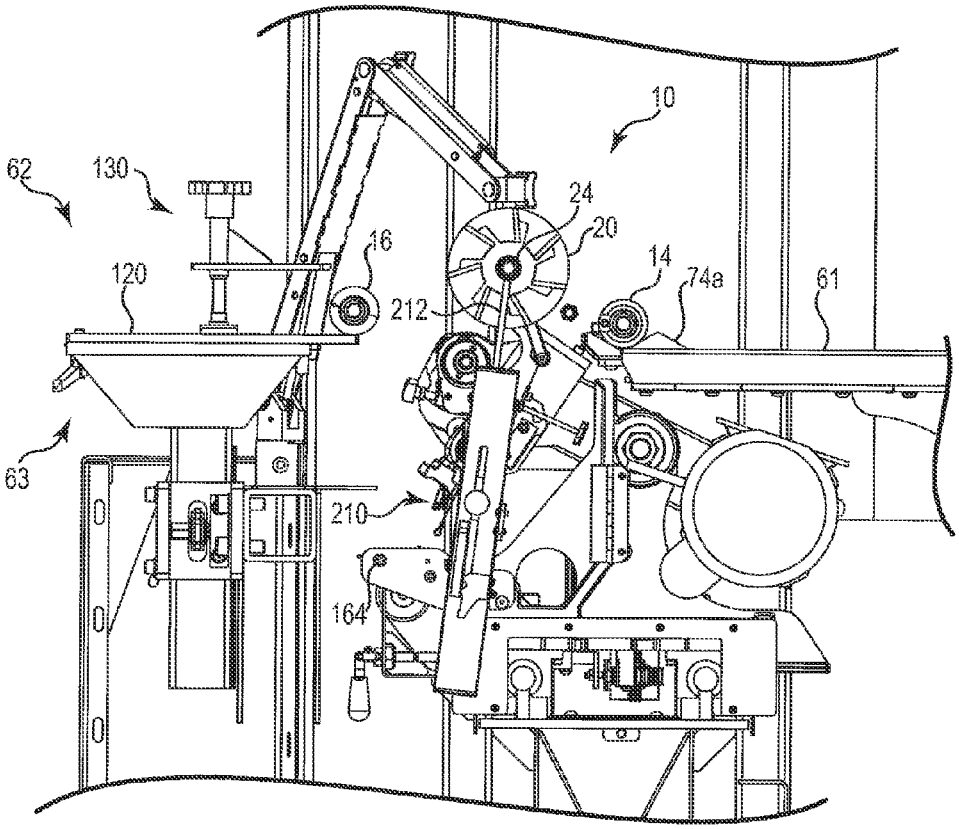
FIG. 14 is a side view of portions of a mower reel grinding system and showing a linear distance gauge positioning, according to one example.

With reference to FIG. 14, after the predetermined distance $d_{BR}$ has been achieved, clamp assembly 90 is employed to secure rear roller 14 to mounting platform 61 and to lock mounting platform 61 to shelf 54, and clamp assembly 130 is employed to secure front roller 16 to support pedestal 63.

Next, with linear distance gauge 210 still aligned with first location marker 202 and still mounted to first mounting pin 162, cutting reel 20 is rotated so that measuring shaft 212 can be extended to contact shaft 24 of cutting reel 20. Linear distance gauge 210 then provides a signal to microcontroller 66 indicating a distance ($d_{S1}$) to the shaft 24 of cutting reel 20 at first location marker 202. Carriage 152 is then moved so that linear distance gauge 210 aligns with second location marker 204. Measuring shaft 212 of linear distance gauge 210 is again extended to contact shaft 24 of cutting reel 20, and linear distance gauge 210 provides a signal to microprocessor controller 66 indicating a distance ($d_{S2}$) to the shaft 24 of cutting reel 20 at second location marker 204.

Based on distances $d_{BR}$, $d_{S1}$, and $d_{S2}$, as described above, and knowing the locations (i.e. first and second location markers) at which such distances were measured relative to the pivot point of traverse base assembly 56 formed by mounting assembly 144 (see FIG. 8), microprocessor controller 66 determines the necessary adjustment to support beam 140 of traverse base assembly 56 (i.e. via second wheel 150, see FIG. 8) so that grinding wheel shaft 172 of grinding head assembly 58 (see FIG. 9) will be vertically paralleled (i.e. in the x-z plane) with the shaft 24 of cutting reel 20.

According to one example, microprocessor controller 66 provides indication of how to adjust second wheel 150 so as to vertically adjust the position of support beam 140, and thus grinding wheel shaft 172, and provides indication of when grinding wheel shaft 172 is vertically paralleled (i.e. in the x-z plane) with shaft 24 of cutting reel 20. In one example, such indication is via a GUI of microprocessor controller 66. In another example, such indication is via a set of indicating lights 266 disposed on enclosure 52, with a first light 266*a* indicating that second wheel 150 should be turned clockwise, a second light 266*b* indicating that second wheel 150 should be turned counter-clockwise, and a third light 266*c* indicating when grinding wheel shaft 172 is vertically paralleled with shaft 24 of cutting reel 20. In one example, the indicating lights are light emitting diodes (LEDs).

Figure 15:
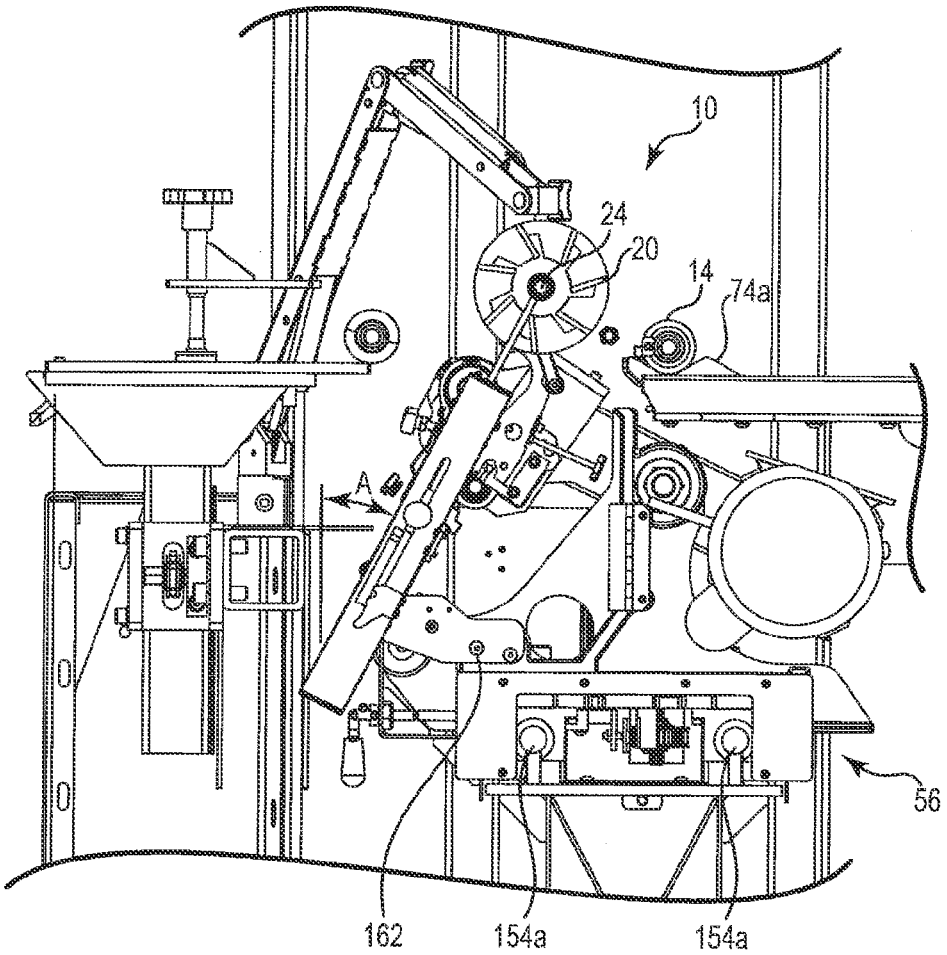
FIG. 15 is a side view of portions of a mower reel grinding system and showing a linear distance gauge positioning, according to one example.

With reference to FIG. 15, after grinding wheel shaft 172 has been vertically paralleled with shaft 24 of cutting reel 20, linear distance gauge 210 is mounted to second mounting pin 164 on carriage 152, and carriage 52 is moved so that linear distance gauge 210 is aligned with first location marker 202. When mounted to second mounting pin 164, linear distance gauge 210 is disposed at an angle A to vertical. Measuring shaft 212 is extended to contact shaft 24 of cutting reel 20, and linear distance gauge provides a signal to microprocessor controller 66 indicating a distance ($d_{S3}$) to shaft 24. The process is repeated with linear distance gauge 210 aligned with second location marker 204 to provide microprocessor controller 66 with a signal indicating a distance ($d_{S4}$) to shaft 24.

Similar to that described above with regard to vertical adjustment of traverse base assembly 56, based on distances $d_{BR}$, $d_{S3}$, and $d_{S4}$, and on angle A, and knowing the locations (i.e. first and second location markers) at which such distances were measured relative to the pivot point of traverse base assembly 56 formed by mounting assembly 144 (see FIG. 8), microprocessor controller 66 determines the necessary adjustment to support beam 140 of traverse base assembly 56 (i.e. via first wheel 148, see FIG. 8) so that grinding wheel shaft 172 of grinding head assembly 58 (see FIG. 9) will be horizontally paralleled (i.e. in the x-y plane) with the shaft 24 of cutting reel 20. According to one example, indication of how adjust first wheel 148 is similar to that described above with respect to second wheel 150.

Returning to FIG. 12, after grinding wheel shaft 172 has been both vertically and horizontally aligned with shaft 24 of cutting reel 20, as described above, a spin drive motor 230 of spin drive system 64 is removably coupled to shaft 24 of cutting reel 20 and rotates cutting reel 20 during the spin and relief grinding processes. According to one example, operation spin drive motor 230 is controlled via microprocessor controller 66.

Figure 16:
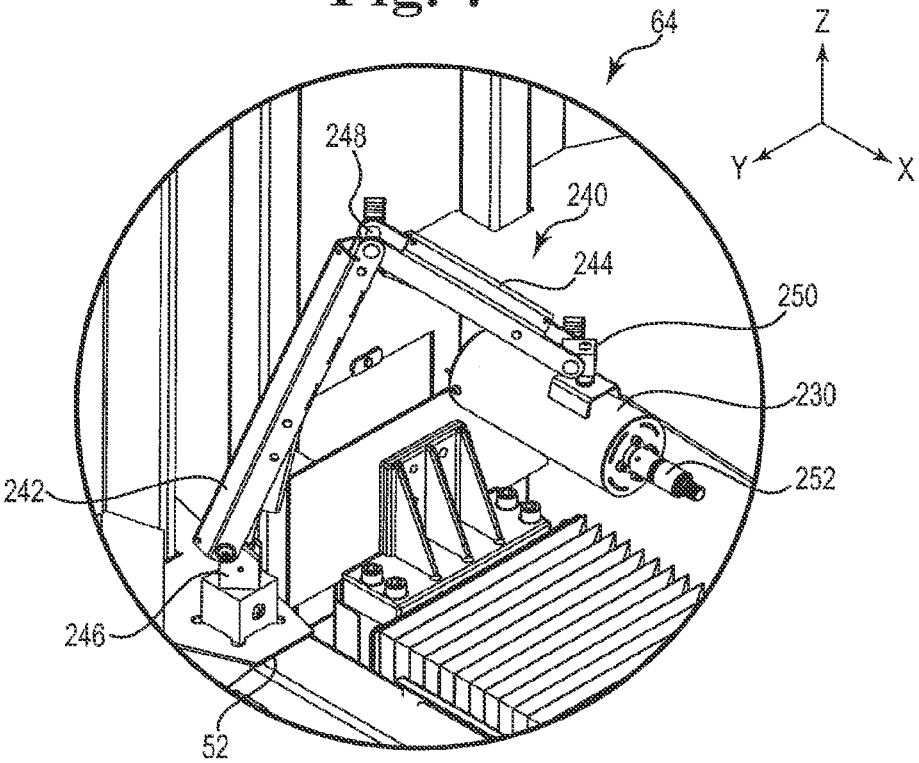
FIG. 16 is a perspective view illustrating a spin drive system according to one example.

FIG. 16 is a perspective view illustrating spin drive system 64. According to one example, spin drive motor 230 is mounted to an articulating arm assembly 240 including a first arm segment 242 and a second arm segment 244. A first end of first arm segment 242 coupled to a frame element of enclosure 52 with a mounting bracket 246 than enables first arm segment 242 to spin around the z-axis and move up and down in the x-z dimension. A first end of second arm segment 244 is coupled to a second end of first arm segment 242 via a hinge that enables second arm segment 244 to be moved up and down in the x-z dimension. A second end of second arm segment 244 is coupled to spin drive motor 230 and enables spin drive motor 230 to be rotated about an axis in the x-y plane and about to be rotated about the said axis in the x-y plane. A shaft 252 of spin drive motor 230 can be fitted with adapters to enable releasable connection of shaft 252 to the shaft 25 of cutting reel 20 of any number of mower unit types. Articulating arm assembly 240 supports spin drive motor 230 and enables movement in any dimension, thereby providing quick and easy connection to cutting reels 20.

Figure 17:
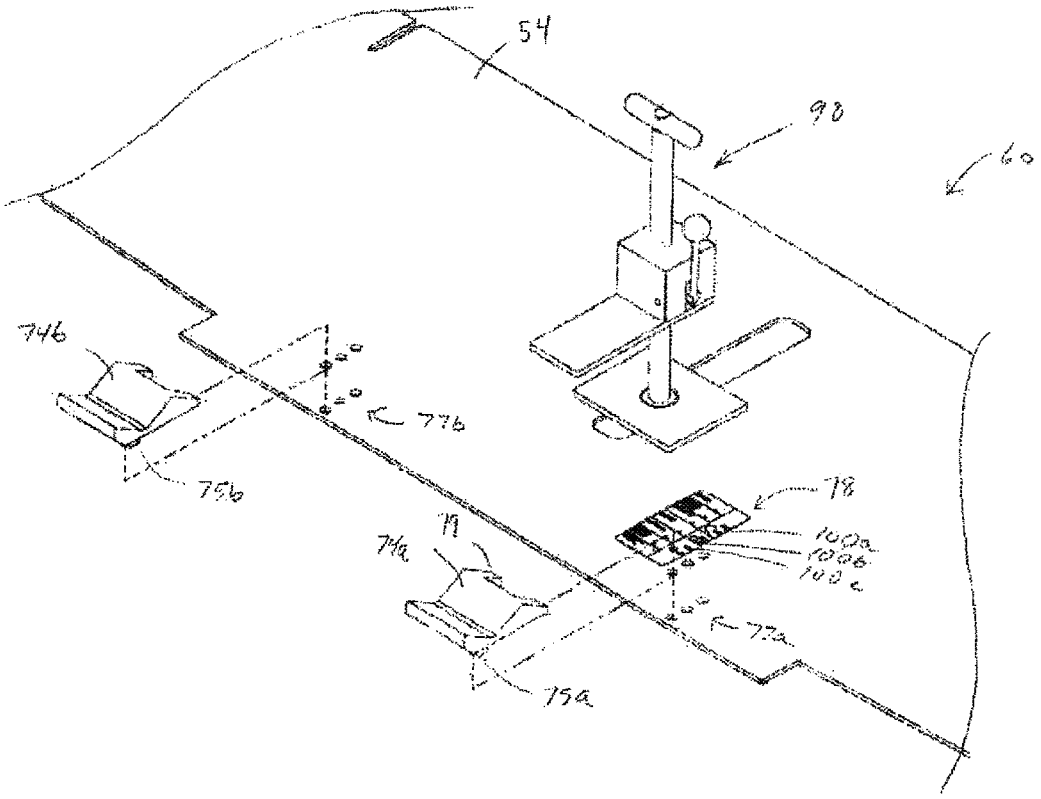
FIG. 17 is a perspective view illustrating a mower reel mounting assembly according to one example.

FIG. 17 is a perspective view illustrating an example of another implementation of rear mounting assembly 60 for positioning brackets 74*a* and 74*b*. According to such example, in lieu of fixedly mounting brackets 74*a*, 74*b* on moveable mounting platform 61, moveable mounting platform 61 is eliminated and brackets 74*a* and 74*b* themselves are moveable between predetermined locations on shelf 54 of enclosure 52. Brackets 74*a*, 74*b* include a pair of offset mounting pins 75*a*, 75*b* (only one pin shown) which are configured to be inserted into corresponding pairs of offset mounting holes 77*a*, 77*b* in shelf 54. In the illustrated example, each of the three pairs of offset mounting holes 77*a*, 77*b* corresponds to one of the index markings 100*a*, 100*b*, and 100*c* of position indexer 78, as described above by FIGS. 5, 6A, and 6B. Similar to that described above, clamp assembly 90 is employed to secure rear roller 14 of mower unit 10 to brackets 75*a*, 75*b* and shelf 54. In one example, a rear edge 79 of bracket 74*a* is configured to align with one of the index markings 100*a*, 100*b*, and 100*c* when mounting pins 75*a* are positioned in the corresponding pair of mounting holes 77*a*. In example, in lieu of using two brackets 74*a*, 74*b*, a single bracket 74 is employed which extends between the sets of mounting holes 77*a*, 77*b*.

By employing a rear mounting assembly including a mounting brackets which are moveable to predetermined, preset locations for any number of types of mower units, grinding system 50 according to the present disclosure provides fast, accurate, and repeatable horizontal positioning for grinding of cutting reels 20 of any number of different types. Additionally, using a linear measuring gauge 210 and microprocessor controller 66 to determine necessary adjustments to traverse base 56 provides rapid, accurate, and consistent paralleling of grind wheel shaft 172 with shaft 24 of cutting reel 20. Furthermore, using relief angle indexer 198 and adjustment knob 196 enables simple and rapid adjustment of grinding head assembly 58 to provide consistent and accurate grinding of relief bevels 25 on blades 22.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A mower reel grinding apparatus for a plurality of types of mower units, each type of mower unit having a pivot mechanism having a pivot axis at a fixed, non-adjustable horizontal distance from an axis of rotation of a cutting reel, the apparatus comprising:

a grinding wheel;

a bracket configured to receive and releasably secure to the pivot mechanism of any one of the plurality of types of mower units, the bracket moveable in only a horizontal plane along a positioning axis to any one of a number of predetermined, fixed positions, each predetermined, fixed position corresponding to at least one type of mower unit of the plurality of types of mower units; and a position selector to releasably secure the bracket at a selected one of the predetermined, fixed positions corresponding to the type of mower unit whose pivot mechanism is to be releasably secured thereto such that a cutting reel of the mower unit will be positioned at a desired position relative to the grinding wheel.

2. The mower reel grinding apparatus of claim 1, wherein a type of mower unit is defined by characteristics including at least one of a manufacturer of the mower unit, a diameter of the cutting reel, and a number of blades on the cutting reel.

3. The mower reel grinding apparatus of claim 1, wherein the bracket secures to the pivot mechanism so that an axis of rotation of the cutting reel is parallel to the horizontal plane and perpendicular to the positioning axis.

4. The mower reel grinding apparatus of claim 1, wherein the pivot mechanism comprises a rear roller of the mower unit, the pivot axis comprises an axis of rotation of the rear roller.

5. The mower reel grinding apparatus of claim 1, wherein the at least one bracket comprises two brackets.

6. The mower reel grinding apparatus of claim 1, further including:

a mounting platform moveable in the horizontal plane along the positioning axis, wherein the at least one bracket is fixed to the mounting platform.

7. The mower reel grinding apparatus of claim 6, including a clamping assembly that clamps the pivot axis to the at least one bracket and clamps the mounting platform to an enclosure of the mower reel grinding apparatus.

8. A mower reel grinding apparatus comprising:

at least one bracket moveable in a horizontal plane along a positioning axis to any one of a number of predetermined positions and configured to releasably secure to a pivot mechanism of a plurality of types of mower units, the pivot mechanism having a pivot axis, each type of mower unit including a cutting reel positioned at a known location relative to the pivot axis, and each of the predetermined positions corresponding to at least one type of mower unit of the plurality of types of mower units, wherein the at least one bracket is moved to the predetermined position corresponding to the type of mower unit secured thereto such that the cutting reel is positioned at a desired grinding position along the positioning axis when the pivot axis is secured to the bracket;

a traverse base assembly on which a grinder having a shaft for a grinding wheel is mounted, the traverse base having a first end mounted to a pivot and an opposing second end horizontally moveable along the positioning axis and vertically moveable perpendicularly to the positioning axis via an adjustment assembly to enable the grinder shaft to be paralleled to a rotational shaft of the cutting reel; and an electronic display that provides visual indication when the grinding shaft is vertically paralleled with the rotational shaft and when the grinding shaft is horizontally paralleled with the rotational shaft.

9. The mower reel grinding apparatus of claim 1, where the electronic display comprises a graphical user interface of a controller.

10. The mower reel grinding apparatus of claim 1, where in the electronic display comprises a set of indicating lights which indicate a which direction to move the second end horizontally and vertically and when the grinding wheel shaft is parallel with the rotational shaft of the cutting reel.

11. The mower reel grinding apparatus of claim 1, further including a guide assembly including:

a guide finger configured to engage a blade of the cutting reel to enable the grinding wheel to grind an angled relief bevel on the blade, wherein the guide finger is rotationally adjustable about a circumference of a grinding wheel to adjust an angle of the bevel to a desired angle;

a plurality of index marking each corresponding to a different angle for the relief bevel;

a pointer; and an adjustment mechanism which operates to rotate the guide finger about the circumference of the grinding wheel until the pointer aligns with and points to an index marking that corresponds to the desired angle.

12. A method of aligning a plurality of types of mower units for grinding in a grinding apparatus, each type of mower unit including a pivot mechanism having a pivot axis and a cutting reel having a rotational shaft positioned at a known, non-adjustable horizontal distance from the pivot axis, the method including:

providing a number of predetermined positions along a positioning axis of the grinding apparatus in a horizontal plane, each predetermined position corresponding to at least one type of mower unit and being based on the known, non-adjustable horizontal distance of the at least one type of mower unit type;

securing a movable bracket at the predetermined position corresponding to the type of mower unit to be aligned in the grinding apparatus; and releasably securing the pivot mechanism of a mower unit to the moveable bracket, such that when secured, the rotational shaft of the cutting reel is positioned at a desired grinding location along the positioning axis, the rotational shaft being positioned perpendicular to the positioning axis.

13. The method of claim 12, wherein releasably securing the pivot mechanism of the mower unit at the predetermined position includes:

positioning at least one moveable mounting bracket that the predetermined position; and securing the pivot mechanism of the mower unit to the at least one mounting bracket.

14. The method of claim 12, wherein a grinding assembly having a grinding wheel axis is moveable along a traverse base which is substantially perpendicular to the positioning axis, and wherein the traverse base has first end mounted to a pivot point and an opposing second end horizontally moveable along the positioning axis and vertically moveable perpendicularly to the positioning axis, the method including:

vertically adjusting the second end of the traverse base until a vertical distance between the traverse base and a circumference of the cutting reel at its lowest vertical point is at a desired vertical distance.

15. The method of claim 14, wherein the desired vertical distance is the same for all types of mower units.

16. The method of claim 14, including:

measuring a first distance from a first point on the grinder assembly to the rotational shaft of the cutting reel with the grinder assembly positioned at a first known location at a first distance from the pivot point;

measuring a second distance from the first point on the grinder assembly to the rotational shaft of the cutting reel with the grinder assembly positioned at a second known location at a second distance from the pivot point;

determining from the first and second distances an amount to vertically adjust the second end of the traverse base such that the grinding wheel axis is vertically paralleled to the rotational shaft of the cutting reel; and vertically adjusting the second end of the traverse base by the determined amount.

17. The method of claim 16, including:

measuring a third distance from a second point on the grinder assembly to the rotational shaft of the cutting reel with the grinder assembly positioned at the first known location;

measuring a fourth distance from the second point on the grinder assembly to the rotational shaft of the cutting reel with the grinder assembly positioned at a second known location;

determining from the third and fourth distances an amount to horizontally adjust the second end of the traverse base such that the grinding wheel axis is horizontally paralleled to the grinding wheel axis; and horizontally adjusting the second end of the traverse base by the determined amount.

18. The method of claim 15, wherein the first and second distances from the first pin to the rotational shaft are at a first angle from vertical, and the third and fourth distances from the first pin to the rotational shaft are at a second angle from vertical.

19. The method of claim 12, wherein the pivot mechanism comprises a rear roller of the mower unit.

20. A mower reel grinding apparatus comprising:

a grinding wheel;

a mounting assembly configured to releasably secure a plurality of different types of mower units at corresponding desired positions for grinding, each type of mower unit including a cutting reel having a plurality of helical blades with a corresponding desired bevel angle; and a guide assembly including:

a guide finger configured to successively engage each of the helical blades of the cutting reel of a mower unit releasably secured to the mounting assembly to enable the grinding wheel to grind the desired relief bevel on the blades, wherein the guide finger is rotationally adjustable about a circumference of the grinding wheel to adjust the bevel angle;

a plurality of index marking each corresponding to a desired bevel angle of at least one type of mower unit;

a pointer; and an adjustment mechanism which operates to rotate the guide finger about the circumference of the grinding wheel until the pointer aligns with and points to the index marking corresponding to the desired bevel angle of the type of mower unit secured to the mounting so that the grinding wheel grinds the relief bevel at the desired bevel angle.

21. A mower reel grinding apparatus comprising:

a mounting assembly configured to releasably secure a plurality of different types of mower units at corresponding desired positions for grinding, each type of mower unit including a cutting reel having a plurality of helical blades with a corresponding desired bevel angle;

a grinding wheel;

a spin drive motor configured to couple to the cutting reel and to spin the cutting reel during grinding of the helical blades by the grinding wheel, wherein the spin drive motor is mounted to an articulating arm assembly that enables lateral and rotational movement of the spin drive motor along and about the x-, y-, and z-axes.

22. A mounting apparatus for mounting a plurality of types of mower units in a mower unit grinding apparatus, each type of mower unit having a cutting reel having a rotational axis at a fixed horizontal distance from a rotational axis of a rear roller, the mounting apparatus comprising:

a mounting platform to which a mounting bracket is fixedly secured, the mounting bracket to receive the rear roller to a mower unit to be mounted thereto, the mounting platform moveable in only a horizontal plan to any one of a number of predetermined fixed positions along a positioning axis, each predetermined fixed position corresponding to at least one type of mower unit a position selector to secure the mounting platform at a selected predetermined fixed position corresponding to a type of mower unit received by the mounting bracket; and a clamp to reliably secure the rear roller to the mounting bracket.

23. The mower reel grinding apparatus of claim 1, wherein each predetermined, fixed position is based on the fixed non-adjustable horizontal distance between the pivot axis of the pivot mechanism and an axis of rotation of the cutting reel of the at least one type of corresponding mower unit.

* * * * *